US007540252B2

(12) United States Patent
Carbonel

(10) Patent No.: US 7,540,252 B2
(45) Date of Patent: Jun. 2, 2009

(54) AUTOSTABILIZER DEVICE FOR BOAT HULL

(76) Inventor: Claude Carbonel, Anse du Pharo, 13007 Marseille (FR)

( * ) Notice: Subject to any disclaimer, the term of this patent is extended or adjusted under 35 U.S.C. 154(b) by 0 days.

(21) Appl. No.: 11/815,352

(22) PCT Filed: Feb. 20, 2006

(86) PCT No.: PCT/FR2006/000371

§ 371 (c)(1),
(2), (4) Date: Aug. 2, 2007

(87) PCT Pub. No.: WO2006/090049

PCT Pub. Date: Aug. 31, 2006

(65) Prior Publication Data

US 2008/0149015 A1 Jun. 26, 2008

(30) Foreign Application Priority Data

Feb. 25, 2005 (FR) ..... 05 01914

(51) Int. Cl.
*B63B 43/06* (2006.01)
*B63B 1/32* (2006.01)

(52) U.S. Cl. ..... 114/125; 114/291

(58) Field of Classification Search ..... 114/125
See application file for complete search history.

(56) References Cited

U.S. PATENT DOCUMENTS 3,316,874 A * 5/1967 Canazzi ..... 114/67 A
4,231,314 A * 11/1980 Peters ..... 114/291
4,528,927 A * 7/1985 Iizuka et al. ..... 114/125

* cited by examiner

*Primary Examiner*—Jesus D Sotelo
(74) *Attorney, Agent, or Firm*—Collen IP; Donald J. Ranft

(57) ABSTRACT

An apparatus or integrated hull design to stabilize boats with V-shaped hulls. This invention includes a cavity affixed to the inside of the hull confirming to the shape of the inside of the hull. The hull has a step toward the rear of the hull to transition from the V-shape to an essentially flat shape. An opening is provided through the hull and cavity in the step. The cavity extends above water level and is provided with a cover and a vent. The design allows water to enter the cavity enhancing stability when idle or at slow speed and to exit the cavity when at higher speed.

6 Claims, 2 Drawing Sheets

AUTOSTABILIZER DEVICE FOR BOAT HULL

BACKGROUND

The object of the present invention is an autostabilizer device for a boat hull.

It generally relates to the industrial sector of the construction of boats of any dimensions and is designed to ensure the stability of boats with a "V"-shaped hull during maneuvers and displacements at very low speeds, or when stationary.

The current naval construction techniques have made it possible to make boats lighter and consequently to reduce their displacement, which is a factor of economy when running, but one of instability at low speeds, which is particularly true for "V"-shaped hulls, which have a good directional stability, but have to be loaded to be stable when stationary, which prevents the boats from being able to be made lighter to have a higher performance, because this stability depends on the position of the center of gravity to the center of buoyancy. It may be considered that the stablest boat is the lifebuoy because it does not have buoyancy at its center and in this case the stability is maximum when stationary.

To navigate comfortably, a boat has to comprise a "V"-shaped hull, in order to cut through the sea, the center of pressure and the center of gravity pass through the same axial point, and consequently, when stationary or at low speeds, such a boat lacks stability.

The prior-art devices tending to improve this stability without being a detriment to the behavior of the boat at high speeds have, in fact, only attempted to lessen the disadvantages of the "V"-shaped hull without being able to confer the stability of multihulls on them.

In some embodiments, water is used as a ballast to stabilize the boat when stationary, thanks to a tunnel or water ballast along the keel or in the hull, with a more or less large opening in the rear, which can be controlled and a vent at the prow. In these devices, the water does not drain out instantaneously when starting and the boat has to receive a more significant amount of energy to move, and if the water is preserved as a ballast, the increase in displacement requires a structural reinforcement, leading to a higher manufacturing cost and a higher consumption of energy.

The author of the present application has filed a plurality of patents, attempting to solve these problems, and in particular:

- Patent No. FR 2 499 929 pertains to a boat combining a flat bottom with a "V"-shaped hull open in the front and in the rear. However, it has the drawback of only permitting the mounting of outboard-type motors and of requiring a great immersion depth of the propeller, which limits the application of the device to small-size boats. In addition, the tunnel, which is flush at the rear, has a high fragility and opposes a major resistance when running backwards.
- Patent No. FR 2 650 550 describes a "V"-shaped hull comprising a flat, internal bottom forming with the said hull a stabilizing enclosure that is closed in the front, and provided with a vent emerging at the top part of the bow, the said enclosure being interrupted, with the transom plate recessed. However, this arrangement may only be applied to new boats and increases the cost of the boat to a considerable extent. In addition, due to its design proper, the enclosure changes the longitudinal balance of the boat when it is filled with water.
- Patent No. FR 2 720 716 describes a boat consisting of a hull having a flat or concave bottom and an inverted "V"-shaped element, fitting detachably under the said hull to form a tunnel, interrupted with the transom plate recessed and closed in the front, whose center of gravity is more or less at the center of gravity of the boat, the said tunnel being able to be filled with water when stationary and to be drained when running thanks to the lateral vents. This device has the drawback of not being able to fit on a "V"-shaped hull.

SUMMARY

The goal of the present invention is to eliminate the drawbacks of the prior-art systems. In fact, it makes it possible to produce boats with a "V"-shaped hull having an excellent lateral and longitudinal stability, both when running and when stationary. It can be adapted to existing hulls of this type without major modifications.

The object of the present invention consists of a deck comprising a more or less central and fixed cavity and to be able to be made integral with a "V"-shaped hull with a step, the bottom of this cavity corresponding to the shape of the inside of the hull at the level of the step and being fixed on the bottom of the hull and on the step, an opening passing through the step and the cavity enabling water to enter when stationary and to exit when running, the cavity comprising a removable covering cap with prow side vent to permit the circulation of air.

DRAWINGS

On the attached drawings, given as a nonlimiting example of an embodiment according to the present application:

PREFERRED EMBODIMENT OF INVENTION

Figure 1:
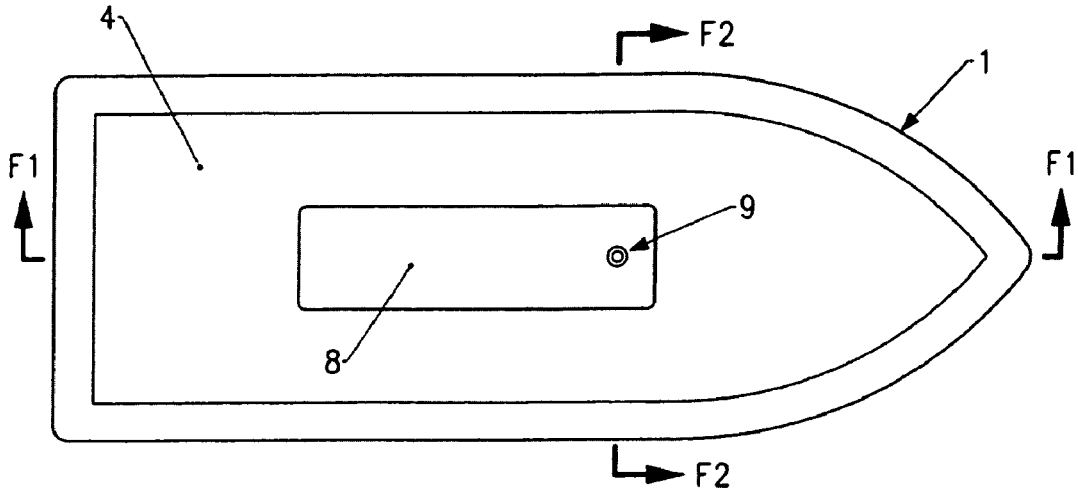
FIG. 1 is a plan view of a boat with a stabilizing cavity.
Figure 2:
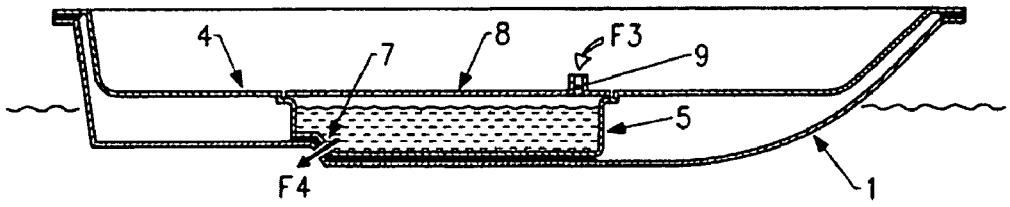
FIGS. 2 and 3 are vertical sections according to arrows F1 and F2 of FIG. 1, respectively.
Figure 3:
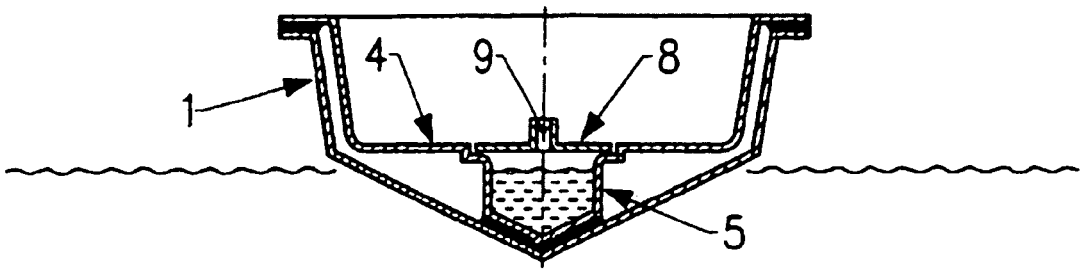
Figure 4:
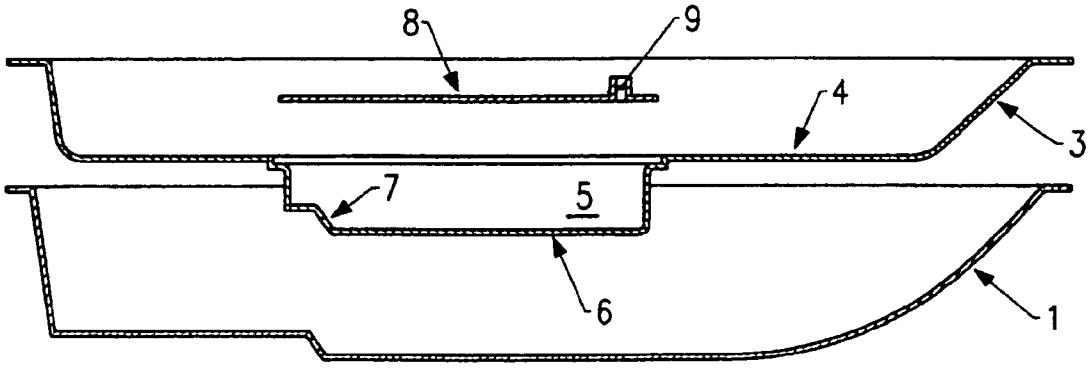
FIG. 4 is a longitudinal vertical section showing the unassembled components of the system.

The device, FIGS. 1 through 4, consists of the combination of a "V"-shaped hull with a step 2 of the classical design and of an internal structure 3 integrating the deck 4.

The hull includes a transition step from a "V" shape to essentially flat rear portion of hull to improve the dynamic efficiency by reducing the wetted surface of the hull provided that they are sufficiently fed with air so as not to create a depression.

The internal structure 3, which is designed to be fixed on the hull 1, is fixed in such a way that the deck line (line of junction with the hull) of the deck 4 is above the water line and comprises a more or less central cavity 5, whose bottom 6 conforms in shape to the bottom of the hull at the level of the step 2 and is fitted by adhesive bonding or any other suitable means inside the hull and on the step.

The rear of the bottom of the cavity 5, forming a block with the hull 1, is pierced by an opening 7 passing through the hull and the wall of the cavity, and protected in the direction of moving forward by the step 2 to enable water to enter and to exit as well as air to pass freely to prevent a depression.

The cavity 5 is closed at the level of the deck line 4 by a panel removable for access and provided with a vent 9 putting the cavity into communication with the open atmosphere, this vent being fixed as a function of the opening 7 in the hull so that the air circulates freely so as to enable the cavity to be filled with water when stationary and to be drained when running.

When stationary or at slow speed, the water penetrates through the opening 7 located at the bottom of the hull 1, the air is driven through the vent 9. When balance is created (weight of the water volume displaced by the body=weight of the boat), the water line is below the deck line of the deck 4, which affects the buoyancy, the stability is maximum.

When the boat picks up speed, the water remains in place and the boat starts to hover, the air replaces the water by passing over the vent 9 and exits through the opening 7 under the hull, preventing a depression from forming behind the step 2, which improves its dynamic efficiency, there is a shifting from a shape stability to a lift stability; by slowing down again, the phenomenon is reversed and the cavity 5 is filled with water driving out the air.

This system may advantageously be constructed with an internal structure 3 in a single piece which may be molded and integrate the deck 4 and the cavity 5, the said structure being fixed on the hull 1 by adhesive bonding or any other means.

The positioning of the various structural components gives the object of the present invention a maximum of useful effects which had not, up to now, been obtained by similar devices.

The invention claimed is:

1. An autostabilizer apparatus for a "V"-shaped hull comprising:

a "V"-shaped hull with a step to transition to a flat shaped rear of the hull;

an internal structure designed to be fixed on the hull;

a deck portion of the internal structure;

a cavity in the internal structure extending below the deck;

an outer surface of a bottom of the cavity conforming in shape to a bottom of the hull including the step;

an opening through the step and the cavity; and a vent on a cover on the cavity.

2. An autostabilizer apparatus according to claim 1 in which the internal structure and cavity are bonded to the hull.

3. An autostabilizer apparatus according to claim 2 in which the deck of the internal structure is positioned to be above the water line.

4. An autostabilizer apparatus according to claim 3 in which the cover with vent are removable.

5. An autostabilizer apparatus according to claim 3 in which the internal structure including cavity are a single piece.

6. An autostabilizer apparatus according to claim 5 in which the internal structure including cavity are molded as a single piece.

* * * * *